US005308274A

United States Patent [19]

Watrobka et al.

[11] Patent Number: 5,308,274

[45] Date of Patent: May 3, 1994

[54] SPARKER VEHICLE SET

[75] Inventors: Ed Watrobka, Sauk Village; Dan Polanek, Beach Park, both of Ill.

[73] Assignee: Marchon, Inc., Vernon Hills, Ill.

[21] Appl. No.: 928,243

[22] Filed: Aug. 10, 1992

[51] Int. Cl.[5] ..... A63H 33/36; A63H 18/00

[52] U.S. Cl. ..... 446/23; 446/444; 446/465

[58] Field of Search ..... 446/444, 23, 22, 445, 446/446, 431, 462, 465; 273/86 B, 86 R; 238/10 A, 10 F

[56] References Cited

U.S. PATENT DOCUMENTS 1,863,587 6/1932 Arnold ..... 446/23
3,646,703 3/1972 Baginski et al. ..... 446/22
4,571,212 2/1986 Kakizaki ..... 446/23 X

*Primary Examiner*—Mickey Yu
*Attorney, Agent, or Firm*—Laff, Whitesel, Conte & Saret

[57] ABSTRACT

A toy vehicle racing system in which sparks are created as the vehicles travel around the racing track. The system includes a sparking rail having a rough surface which interacts with a sparking element mounted on a toy vehicle to create the sparks. The sparking element may be mounted on a swinging member that is adapted to pivot out from the vehicle to engage the rough surfaced sparking rail. The system further includes a sparking vehicle with a rough surface that interacts with a sparking element mounted on another vehicle to create sparks as the vehicles move past one another along the track.

31 Claims, 3 Drawing Sheets

SPARKER VEHICLE SET

FIELD OF THE INVENTION

This invention relates to toy vehicle racing sets. More particularly, this invention relates to toy vehicle racing sets in which sparks are created as the toy vehicles race around the track.

BACKGROUND OF THE INVENTION

Children and adults alike enjoy racing slot cars, and over the years there have been a number of innovations in track configurations, motor performance and body styles. However, even with all of these innovations there have been few developments which add to the realism and excitement of these miniature racing systems.

Typically, toy racing sets include toy vehicles, a series of interconnecting tracks having imbedded electrical power conducting strips and a center slot running the length of the track, power controllers for regulating the electrical current supplied to the conducting strips, and an outside power supply. The vehicles themselves have electrically powered motors which receive electrical current from the conducting strips and guide pins which rest in the track's center slot to help direct the vehicles around the track. Additionally, interchangeable body styles are available which fit over the vehicles' chassis.

As entertaining as these slot car sets can be, they often lack the realism of full-sized auto racing. For example, when full sized stock cars race, the cars frequently brush against the walls of the track. This can create sparks and even accidents, but it is also a very real part of racing. Likewise, the cars themselves sometimes run into each other, again creating sparks. Current toy racing systems lack that realism.

Accordingly, an object of the present invention is to provide a toy vehicle racing set which simulates the realism of full-sized auto racing.

Another object of the present invention is to provide a toy vehicle racing set in which sparks are created when the vehicles move around the track.

Yet another object of the present invention is to provide a toy vehicle racing set which utilizes a guard rail and a flint for creating sparks.

Additional objects and advantages of the invention will become apparent from the following description and drawings.

SUMMARY OF THE INVENTION

The present invention accomplishes the foregoing objects by providing a toy racing system in which sparks are created as the toy vehicles race around a track. The system comprises a specially adapted vehicle and a racing track with a sparking rail having a rough surface and, in one preferred embodiment, a plurality of undulating ridges. The vehicle has a sparking element which interacts with the sparking rail to create sparks as the vehicle travels around the track. In the preferred embodiment of the invention, the rail's rough surface is made up of a plurality of fine silicon carbide chips, while the sparking element is a spark-providing alloy.

When operating the invention, the electrically powered vehicles race around the track through straightaways and high-speed curves, passing by the sparking rails which are placed intermittently throughout the course. When a vehicle approaches a sparking rail, the sparking element is forced up against the rail's rough surface by centrifugal force or by other means, causing friction to build up between the sparking element and the rough surface. This friction in turn creates sparks which become further enhanced when the sparking element engages ridges located along the rough surface of the rail. As the vehicle passes through the area with the sparking rail, the sparks create the illusion that the cars are crashing into the walls.

The above, as well as other objects and advantages of the invention, will become apparent from the following detailed description in which reference is made in the accompanying drawings.

DETAILED DESCRIPTION OF THE INVENTION

Figure 1:
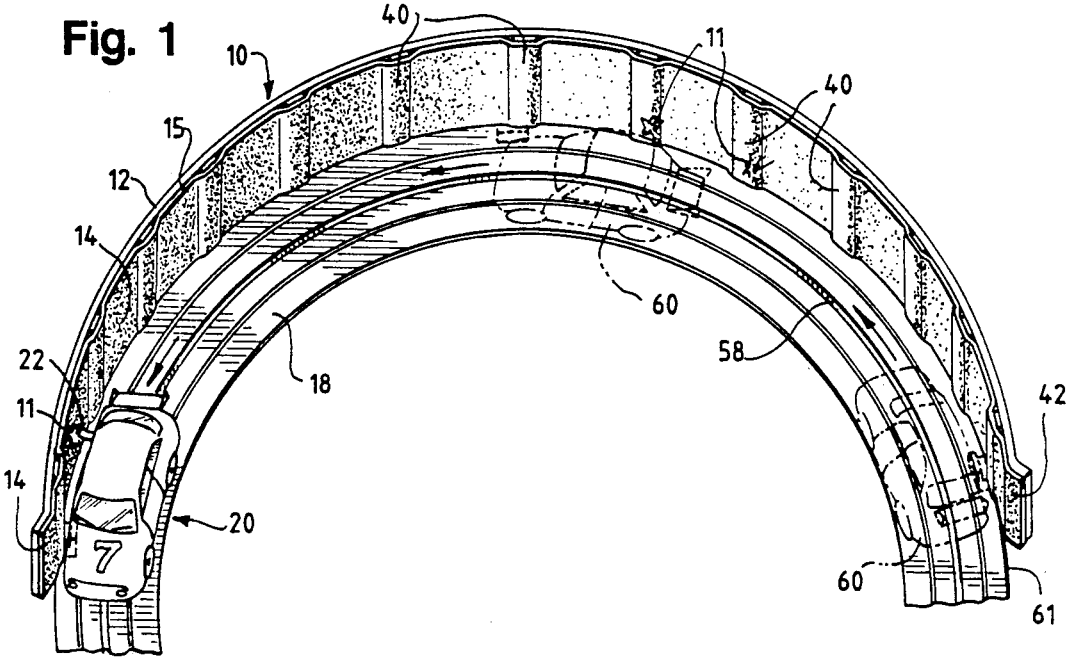
FIG. 1 is a perspective view of the preferred embodiment of the invention, depicting a sparking rail attached to a section of track with slot cars racing around the track.

As shown in the accompanying drawings and described below, a device for creating sparks with a toy racing system is provided comprising a racing track, a toy racing vehicle and means for creating sparks. The means for creating sparks comprises a sparking rail 10, which may be mounted onto the racing track 18, and a sparking element 22, which may be attached to the vehicle 20. The sparking rail 10 includes a plastic strip 12 having a rough surface 14 on one side thereof, and a plurality of fasteners 16 for mounting the rail 10 on a toy racing track 18. When the sparking element 22 comes into contact with the sparking rail 10, sparks 11 are created, giving the illusion that the vehicles 20 are crashing into the rail 10 or each other.

Figure 2:
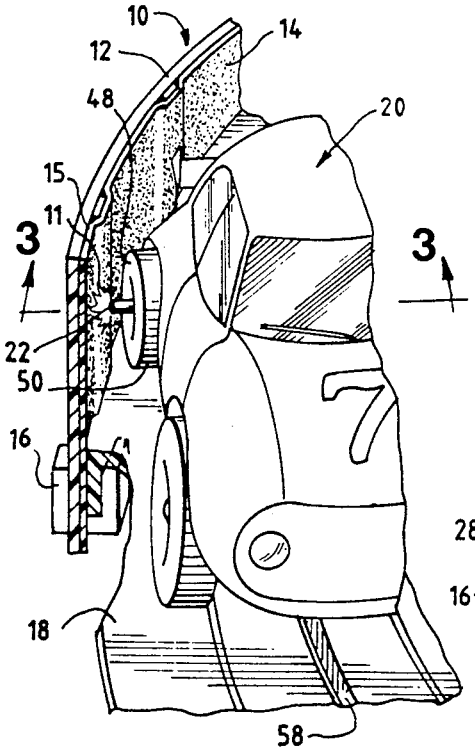
FIG. 2 is a perspective view of the preferred embodiment of the invention, depicting a slot car making sparks against the sparking rail.
Figure 3:
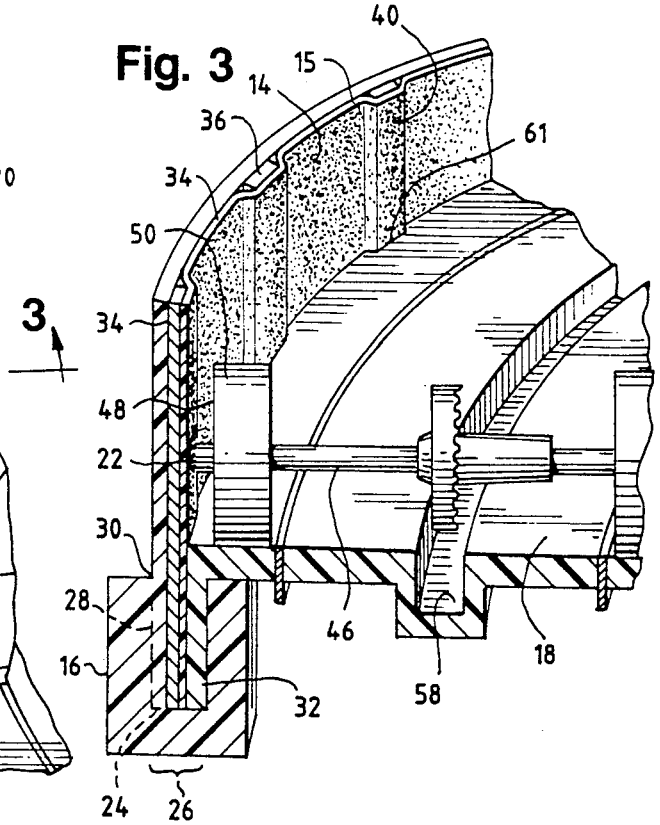
FIG. 3 is a cross-section perspective view of the preferred embodiment of the invention, taken along line 3—3 of FIG. 2, depicting an axle, a section of track and an attached sparking rail.

Fasteners 16 enable the sparking rail 10 to be mounted on a racing track 18, and allow the rail to be removed and replaced when the rough surface 14 has worn down. Fasteners 16 are attached to sparking rail 10 along bottom edge 24, and, as seen in FIGS. 2 and 3, are "U" or "J" shaped. Bottom edge 24 of rail 10 is fitted inside channel 26 of fastener 16, with the interior surface 30 of channel 26 being permanently mounted to the exterior surface 28 of rail 10. The combined thickness of the rail's plastic strip 12 and rough surface 14 is less than the interior dimension of channel 26, leaving the remainder of channel 26 open to receive depending edge 32 of track 18.

Figure 4:
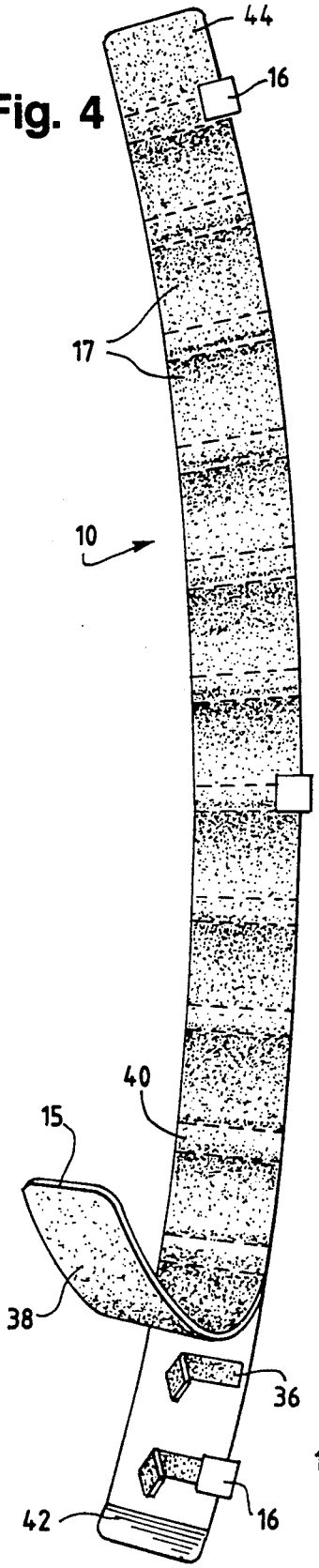
FIG. 4 is a elevational view of the preferred embodiment of the invention, depicting the rough paper being peeled away from the sparking rail.
Figure 5:
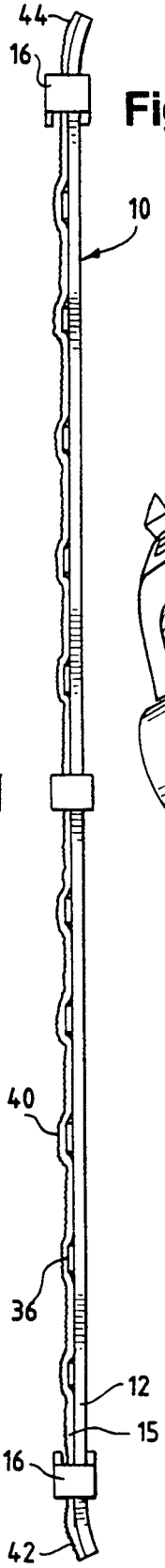
FIG. 5 is a bottom plan view of the preferred embodiment of the invention, depicting the sparking rail.

In the preferred embodiment of the invention, rough surface 14 is created from "sandpaper" 15 which is attached to the interior surface 34 of plastic strip 12. Sandpaper 15 is coated with a plurality of fine chips 17 of an abrasive material such as silicon carbide. As seen in FIGS. 4 and 5, double-sided adhesive tabs 36, as well as an adhesive compound 38, are provided to affix sandpaper 15 to the plastic strip 12. These double-sided adhesive tabs 36 also create ridges 40 which cause sandpaper 15 to undulate along the interior surface of the plastic strip. As discussed below, ridges 40 help create more sparks 11 when the sparking element 22 comes in contact with the rough surface 14 of the sparking rail 10.

In an alternative embodiment of the invention, the rail may be constructed from other materials, such as cardboard or a thin metal. Further, the rough surface of the rail may be created by pre-molding abrasive material onto the rail's interior surface, or, the rail may be directly sprayed or coated with abrasive material, again creating a surface which would cause the sparking element to spark.

Figure 9:
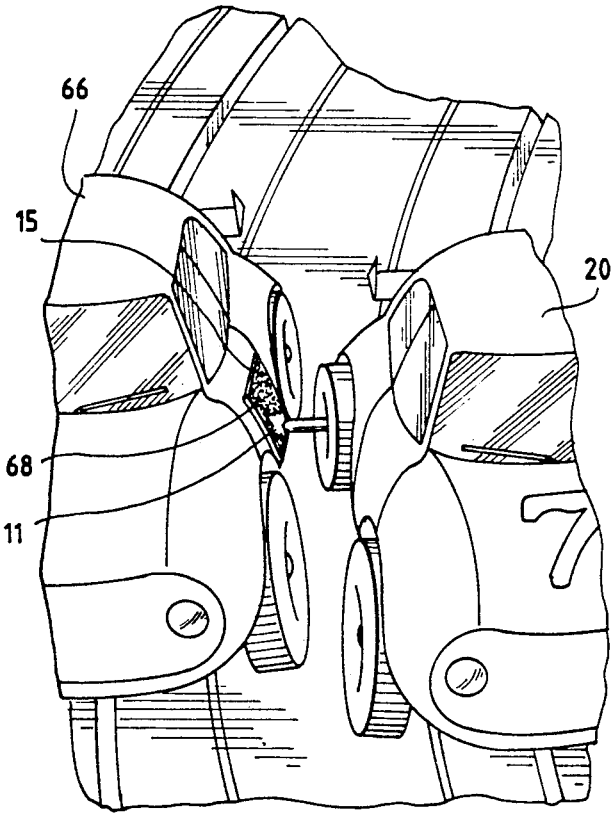
FIG. 9 is a perspective view of an additional embodiment of the invention, depicting one vehicle having a spark-producing material mounted thereon, and another vehicle having a rough paper mounted thereon.
Figure 10:
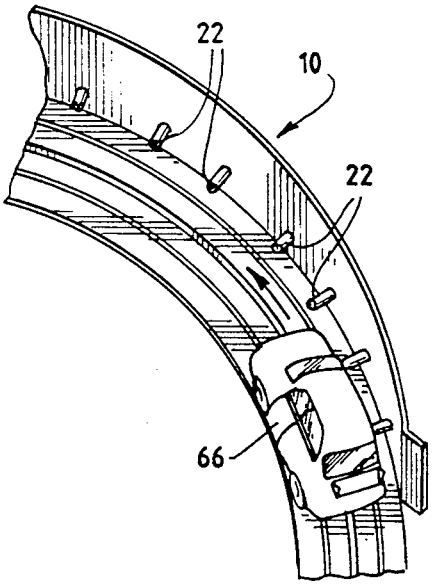
FIG. 10 is a perspective view of an additional embodiment of the invention, depicting the rail having spark-producing elements mounted thereon, and the vehicles having the rough surface mounted thereon.

In yet another embodiment of the invention the vehicle may be provided with the rough surface while the rail includes the sparking element. As seen in FIG. 10, a plurality of sparking elements 22 are fixedly mounted to sparking rail 10. Further, sandpaper 15 is attached to vehicle 66, as seen in FIG. 9, to interact with sparking element 22 on sparking rail 10.

The sparking rail 10 may also be made in a variety of shapes and sizes to conform to different track configurations. In the preferred embodiment of the invention, the rail is shaped in a gentle arc, as shown in FIG. 4 and includes flared portions 42, 44, located at each end thereof. As seen in FIG. 1, flared portion 42 enables vehicle 20 to approach and engage the sparking rail 10 without running into the rail's front edge. This feature is important because the vehicle could be thrown from the track if it collides with the front edge of the sparking rail 10. Additionally, the dual flared portions 42, 44 enable sparking rail 10 to face either direction and to be attached at any location on the track 18.

Figure 6:
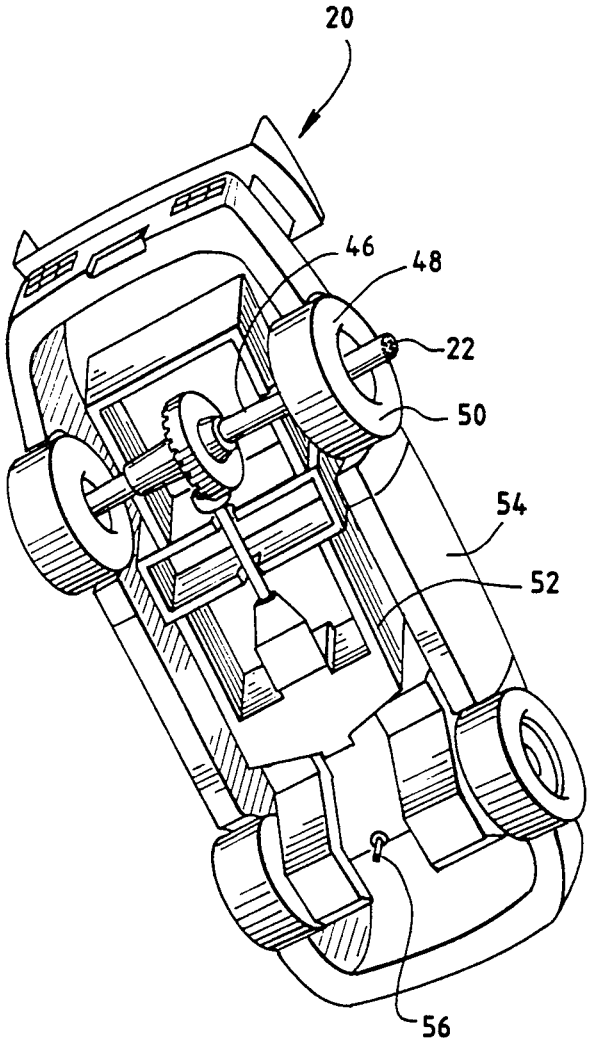
FIG. 6 is an axonometric view of the preferred embodiment of the invention, depicting the underside of the toy slot car.

As seen in FIGS. 2, 3 and 6, the toy vehicle 20 includes a cylindrically shaped sparking element 22 attached to the vehicle's rear axle 46. Sparking element 22 also projects beyond the edge 48 of wheel 50 (FIG. 3), allowing it to strike against rough surface 14 while the body of the vehicle 20 remains clear of the rail 10.

The sparking element 22 is made from a hard, fine grained quartz, such as flint, or from another appropriate spark generating element. It is designed and positioned to create a spark 11 when it strikes against a hard material such as the silicon carbide chips in rough surface 14 (FIG. 2).

Because the sparking element 22 is attached to the axle 46, it rotates as the vehicle travels around the track. This rotation serves two purposes. First, the rotation causes the sparking element 22 to wear down evenly as it strikes against rough surface 14, and second the spinning movement tends to "throw" the sparks from the car, enhancing the realism and excitement of the system.

Figure 7:
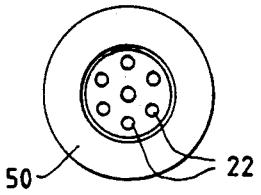
FIG. 7 is an elevational view of an additional embodiment of the invention, depicting a wheel having a plurality of spark-producing elements mounted thereon.
Figure 8:
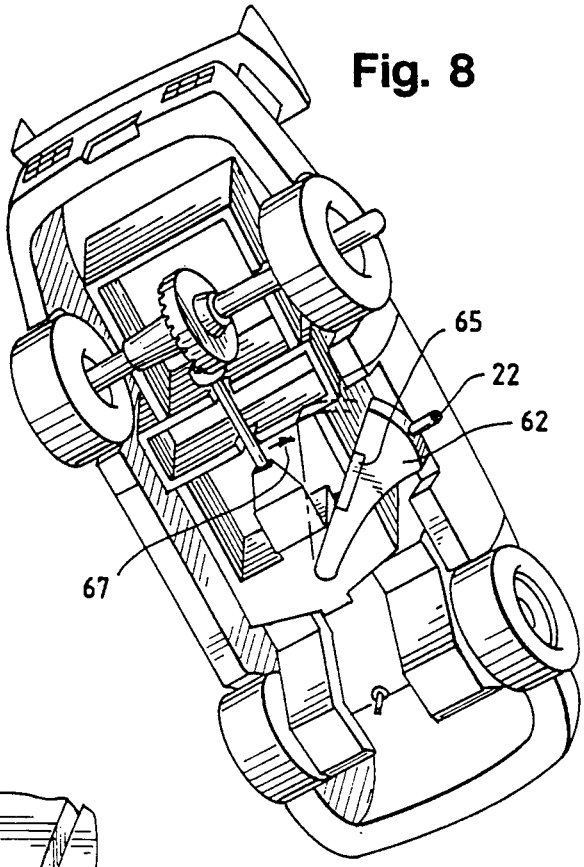
FIG. 8 is a perspective view of an additional embodiment of the invention, depicting the swinging sparker arm.

In alternative embodiments of the invention, the sparking element may be mounted on other portions of the vehicle, such as on chassis 52 or on body 54. A plurality of flints or other spark-producing elements 22 may also be attached to wheel 50 as seen in FIG. 7. Still further, the sparking element 22 could be mounted to a swinging arm 62, as seen in FIG. 8, which would pivot or swing out, as shown by arrow 67, when the vehicle 22 neared rail 10. Arm 62 could be activated by a manual or electric switch in the track or by magnetic means 65 installed in either the track or in a second vehicle (not shown).

As shown in FIG. 9, yet another embodiment of the invention is disclosed. Vehicle 66 includes a rough surface 68 on either side thereon, while vehicle 20 includes sparking element 22 as previously described above. As with the sparking rail, the rough surface of vehicle 66 may be created from an abrasive sandpaper 15 attached to at least one side of vehicle 66, or, it may be created by premolding or spraying an abrasive material onto the vehicle's surface. In either case, abrasive material may be created from silicon carbide or other like material.

Sparks are created between vehicles 20 and 66 in a similar fashion as described above where sparks are created between vehicle 20 and sparking rail 10. As the sparking element 22 of vehicle 20 contacts the rough surface of vehicle 66, sparks are created. However, because the vehicles are moving, sparks may be created anywhere on the racing track, as opposed to being limited to the areas where the sparking rails are located.

The operation of the invention is as follows. Sparking rail 10 is attached to racing track 18 by inserting depending edge 32 of racing track 18 into channel 26 of fastener 16. The interior dimension of channel 26 is slightly less than the combined thickness of the track's depending edge 32, rail 10 and sandpaper 15. However, fastener 16 is flexible, and therefore, when the depending edge 32 is inserted into channel 26, the channel flexes open. This allows rail 10 to be mounted onto racing track 18, and to be securely held in place.

The operator then places a vehicle 20 on the racing track 18 and begins "driving" the vehicle around the track. As the vehicle 20 accelerates around the track 18, it enters a curved section where rail 10 is mounted. The vehicle then moves through the turn, and centrifugal forces cause the vehicle's rear 60 to swing about guide pin 56 to the outside edge 64 of the track. This, in turn, forces the sparking element 22 to strike against rough surface 14 of sparking rail 10 and create sparks 11.

When the vehicle travels around the curve, the rotating sparking element 22 remains in constant contact with rough surface 14. As seen in FIG. 1, from the time the vehicle 22 enters the curve, until the time that it exits the curve, sparks 11 are created. This is a result of three factors. First, the entire rail is covered with rough surface 14 to interact with sparking element 22. Second, as the vehicle 20 accelerates through the turn, centrifugal forces push the vehicle to the outside edge 61 of the track. Third, the aforementioned curve of the track and the position of track groove 58, together with the forward motion of the vehicle 20, cause the sparking element 22 to be continuously forced against the rail 10.

In addition to creating continuous sparks, the sparking rail is also designed to make larger and smaller sparks. Ridges 40 created by the double-sided adhesive tabs 36, and the sandpaper 15, increase the friction between the sparking element 22 and the rail. This increased friction causes the sparking element 22 to create larger sparks than at the flat areas along the rail 10.

Finally, in an alternative embodiment of the invention, sparking rail 10 may be mounted along a straight section of track. There, sparking element 22 would be forced to engage the sparking rail by way of the aforementioned swing arm 62. The arm 62 "swings out" when the vehicle 20 approaches the sparking rail 10, thus causing sparking element 22 to rub against rough surface 14 and create sparks 11 as previously described.

Therefore, it should be recognized that, while the invention has been described in relation to a preferred embodiment thereof, those skilled in the art may develop a wide variation of structural details without departing from the principles of the invention. Accordingly, the appended claims are to be construed to cover all equivalents falling within the scope and spirit of the invention.

The invention claimed is:

1. A toy racing set comprising:

a toy racing track;

a toy vehicle for racing on said racing track;

means associated with both said racing track and said toy vehicle for producing sparks as said vehicle moves along said track, said spark producing means comprising a rough surfaced rail and at least one spark-producing element associated with said toy vehicle, said spark-producing element being made from flint or a spark-producing alloy; and said toy vehicle including a swinging member having at least one of said spark-producing elements mounted thereon, said swinging member being operated by manual switching means and adapted to pivot out from said vehicle to engage said rough surfaced rail.

2. A toy racing set comprising:

a toy racing track;

a toy vehicle for racing on said racing track; and means, associated with both said racing track and said toy vehicle, for producing sparks as said vehicle moves along said track, said spark producing means having a rough surfaced guard rail and at least one spark-producing element associated with said toy vehicle.

3. The racing set of claim 1, in which said rough surfaced guard rail includes a plurality of ridges.

4. The toy racing set of claim 1, wherein said rough surfaced guard rail includes fastening means to mount said rail to said racing track.

5. The toy racing set of claim 1, wherein said rough surfaced guard rail is flexible.

6. The toy racing set of claim 1, wherein said rough surfaced guard rail comprises an elongated member, and a paper coated with fine grains of silicon carbide mounted to said elongated member.

7. The toy racing set of claim 6, wherein said paper is mounted to said guard rail by adhesive means.

8. The toy racing set of claim 1, wherein said rough surfaced guard rail is pre-molded with fine grains of silicon carbide.

9. The toy racing set of claim 1, wherein said rough surfaced guard rail comprises an elongated member with fine grains of silicon carbide coated onto said elongated member.

10. The toy racing set of claim 1, wherein said spark-producing element is made from flint or a spark-producing alloy.

11. The toy racing set of claim 10, wherein at least one of said spark-producing elements is mounted to at least one axle on said toy vehicle.

12. The toy racing set of claim 10, wherein at least one of said spark-producing elements is mounted to the chassis of said toy vehicle.

13. The toy racing set of claim 10, wherein at least one of said spark-producing elements is mounted to the body of said toy vehicle.

14. The toy racing set of claim 10, wherein at least one of said spark-producing elements is mounted to a wheel of said toy vehicle.

15. The toy racing set of claim 10, wherein said toy vehicle includes a swinging member, having at least one of said spark-producing elements mounted thereon, which is adapted to pivot out from said vehicle to engage said rough surfaced guard rail.

16. The toy racing set of claim 15, wherein said swinging member is operated by magnetic means.

17. The toy racing set of claim 15, wherein said swinging member is operated by electric switching means.

18. The toy racing set of claim 15, wherein said swinging member is operated by manual switching means.

19. A toy racing set comprising:

a toy racing track;

a toy vehicle for racing on said racing track;

means associated with both said racing track and said toy vehicle for producing sparks as said vehicle moves along said track, said spark producing means comprising a guard rail having at least one spark-producing element mounted thereon, and a rough surface attached on said toy vehicle.

20. The toy racing set of claim 1, wherein said spark-producing element is made from a flint or a spark-producing material.

21. The toy racing set of claim 1, wherein said rough surface comprises a plurality of fine grains of silicon carbide.

22. A toy racing set comprising:

a toy racing track;

at least two toy vehicles for racing on said racing track; and sparking means associated with said toy vehicles for producing sparks as pairs of said vehicles move past one another along said track.

23. The toy racing set of claim 22, wherein said sparking means associated with said toy vehicles comprises at least one spark-producing element mounted to one of said toy vehicles, and a rough surface on at least one other toy vehicle.

24. The toy racing set of claim 23, wherein said spark-producing element is made from flint or a spark-producing alloy.

25. The toy racing set of claim 23, wherein said rough surface comprises a coating of hard material that includes silicon carbide.

26. A toy racing set comprising:

a toy racing track;

a toy vehicle for racing on said racing track; and means associated with both said racing track and said toy vehicle for producing sparks as said vehicle moves along said track, said spark producing means comprising a rough surfaced rail and at least one spark-producing element associated with said toy vehicle, said rough surfaced rials including a plurality of ridges.

27. A toy racing set comprising:

a toy racing track;

a toy vehicle for racing on said racing track; and means associated with both said racing track and said toy vehicle for producing sparks as said vehicle moves along said track, said spark producing means comprising a rough surfaced rial and at least one spark-producing element associated with said toy vehicle, said rough surfaced rail being flexible.

28. A toy racing set comprising:

a toy racing track;

a toy vehicle for racing on said racing track; and means associated with both said racing track and said toy vehicle for producing sparks as said vehicle moves along said track, said spark producing means comprising a rough surfaced rail and at least one spark-producing element associated with said toy vehicle, said spark-producing element being made from flint or a spark-producing alloy, with at least one of said spark-producing elements being mounted to at least one axle on said toy vehicle.

29. A toy racing set comprising:

a toy racing track;

a toy vehicle for racing on said racing track; and means associated with both said racing track and said toy vehicle for producing sparks as said vehicle moves along said track, said spark producing means comprising a rough surfaced rial and at least one spark-producing element associated with said toy vehicle, said spark-producing element being made from flint or a spark-producing alloy, with at least one of said spark-producing elements being mounted to a wheel of said toy vehicle.

30. A toy racing set comprising:

a toy racing track;

a toy vehicle for racing on said racing track;

means associated with both said racing track and said toy vehicle for producing sparks as said vehicle moves along said track, said spark producing means comprising a rough surfaced rail and at least one spark-producing element associated with said toy vehicle, said spark-producing element being made from flint or a spark-producing alloy; and said toy vehicle including a swinging member having at last one of said spark-producing elements mounted thereon, said swinging member being operated by magnetic means and adapted to pivot out from said vehicle to engage said rough surfaced rail.

31. A toy racing set comprising:

a toy racing track;

a toy vehicle for racing on said racing track;

means associated with both said racing track and said toy vehicle for producing sparks as said vehicle moves along said track, said spark producing means comprising a rough surfaced rial and at least one spark-producing element associated with said toy vehicle, said spark-producing element being made form flint or a spark-producing alloy; and said toy vehicle including a swinging member having at least one of said spark-producing elements mounted thereon, said swinging member being operated by electric switching means and adapted to pivot out from said vehicle to engage said rough surfaced rail.

* * * * *